US005752698A

United States Patent [19]

Desroches

[11] Patent Number: 5,752,698

[45] Date of Patent: May 19, 1998

[54] HOCKEY STICK BLADE PROTECTOR

[75] Inventor: Michel Gilbert Desroches, Penetanguishene, Canada

[73] Assignee: 1134932 Ontario Ltd., Ontario, Canada

[21] Appl. No.: 546,418

[22] Filed: Oct. 23, 1995

[30] Foreign Application Priority Data

Nov. 3, 1994 [CA] Canada ..... 2135005

[51] Int. Cl.[6] ..... A63B 59/14

[52] U.S. Cl. ..... 273/67 A

[58] Field of Search ..... 273/67 A

[56] References Cited

U.S. PATENT DOCUMENTS 3,529,825 9/1970 White, Sr. ..... 273/67 A 5,294,113 3/1994 Ladouceur et al. ..... 273/67 A

*Primary Examiner*—Mark S. Graham

[57] ABSTRACT

A hockey stick blade protector comprising at least one upstanding protector clip and retaining member for retaining the protector clip on a hockey stick blade is disclosed. The blade protector and clip are made of plastic or similar material, and guard the blade's edge against abrasion. The clip comprises a first and second sidewall and a bottom wall defining a cavity for receiving a bottom edge of a hockey stick blade. The bottom wall has a convex bottom surface. The retaining member extends from the first sidewall to the second sidewall of the protector clip over a top edge of the hockey stick blade when the cavity receives the hockey stick blade. The clip and the retaining member each comprise at least one interengageable serration. The clip further has first and second elongate receiving slots for receiving the retaining band in each sidewall. The receiving slots extend generally vertically in the sidewalls, and at least one interengageable serration is deposed in at least one of said receiving slots. Preferably, the protector comprises two clips, one for attachment proximate the blade's toe, the other proximate its heel.

16 Claims, 3 Drawing Sheets

HOCKEY STICK BLADE PROTECTOR

FIELD OF THE INVENTION

This invention relates to a hockey stick blade protector. More particularly, the invention relates to a blade protector that reduces the friction between a hockey playing surface, such as asphalt, pavement, wood or ground, and the hockey stick blade thereby increasing the mobility and speed of motion of the stick.

BACKGROUND OF THE INVENTION

Numerous hockey stick blade protectors are known.

For example, U.S. Pat. No. 4,651,990 discloses a protector comprising a V-shaped sleeve which is taped in place onto a hockey stick blade. This design covers a large portion of the bottom of the blade and does not substantially reduce the contact area of the blade bottom and the playing surface.

Similarly, U.S. Pat. No. 3,377,065 discloses a road hockey stick with ball bearings in its base. This design however, requires a specially modified notched stick blade.

The present invention attempts to overcome some of the disadvantages of the known devices. The invention provides a protector for use with a conventional hockey stick, requiring no modification to the stick.

SUMMARY OF THE INVENTION

In accordance with one aspect of the present invention, there is provided a hockey stick blade protector comprising: an upstanding protector clip comprising a first and second sidewall and a bottom wall defining a cavity for receiving a bottom edge of a hockey stick blade; at least one of said first and second sidewall having at least one sidewall serration extending generally horizontally along a side of said at least one sidewall, exterior to said cavity; and a retaining member for retaining said protector clip on said hockey stick blade, said retaining member extending from said first sidewall to said second sidewall over a top edge of said hockey stick blade when said cavity receives said hockey stick blade; said retaining member having at least one serration adapted to engage said at least one sidewall serration.

In accordance with another aspect of the present invention, there is provided a hockey stick blade protector comprising a first and second protector clip wherein each protector clip comprises: a first and second sidewall and a bottom wall defining a cavity for receiving a bottom edge of a hockey stick blade; said first and second walls having at least one sidewall serration extending generally horizontally along a side of said sidewalls exterior to said cavity; and a retaining member extending from said first sidewall to said second sidewall over a top edge of said hockey stick blade for retaining said protector clip; said retaining member having a plurality of serrations adapted to engage said sidewall serrations; said first clip for attachment to said hockey stick blade proximate a first end of said hockey stick blade and said second clip for attachment to said hockey stick blade proximate a second end of said hockey stick blade.

In accordance with yet another aspect of the invention, there is provided a hockey stick blade protector for attachment to a hockey stick blade comprising: an upstanding protective clip comprising a first and second sidewall and a bottom wall defining a cavity for receiving a bottom edge of a hockey stick blade; wherein said bottom wall has a convex outer bottom surface, when said hockey stick blade is received by said cavity; and a flexible retaining band for attaching said protective clip to said blade and at least one interchangeable serration on each of said clip and said retaining band.

The above will be more clearly understood with reference to the accompanying drawings of preferred embodiments of the invention, in which:

DETAILED DESCRIPTION OF THE PREFERRED EMBODIMENT

Figure 1:
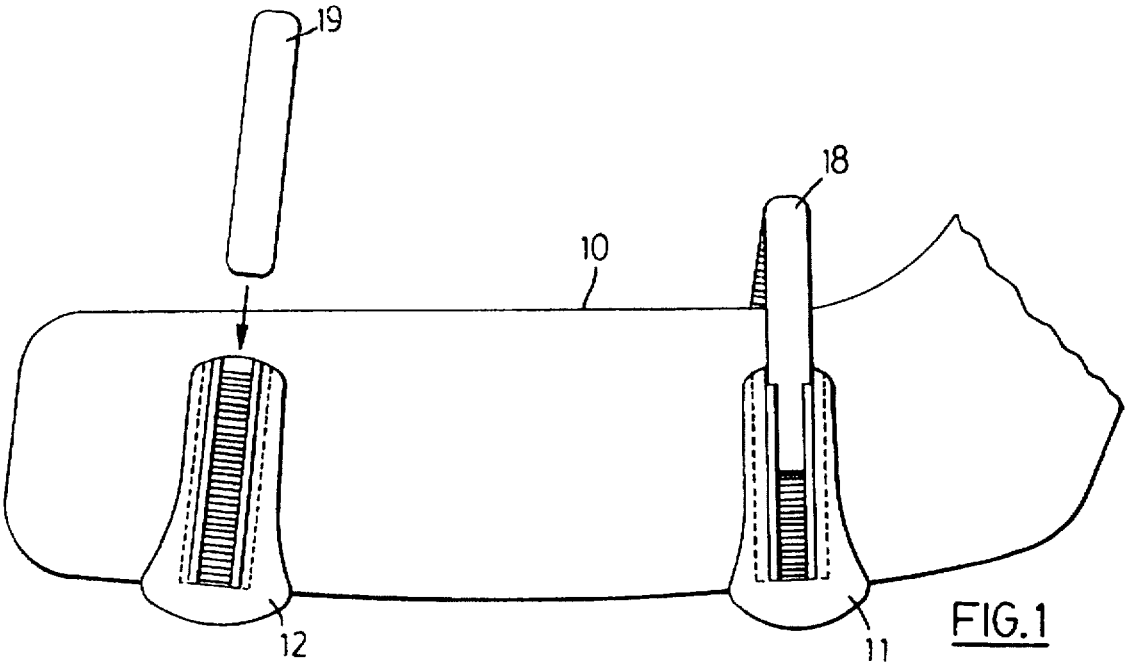
FIG. 1 is a perspective view of a hockey stick blade equipped with a hockey stick blade protector in accordance with an aspect of this invention.

As shown in FIG. 1, the hockey stick blade protector comprises two clips 11 and 12, attachable to a hockey stick blade 10. A first clip 12 is attachable proximate the tip of blade 10, while a second clip 11 is attachable proximate the heel of blade 10.

Each clip 11, 12 is made of moulded plastic, but may be made of nylon, delron or a variation of abrasive materials. In order to accommodate industry standard hockey blades, clip 12 is taller than clip 11 and has a slightly narrower U-shaped cavity 44 (see FIGS. 4, 5). Otherwise, the clips are identical. For simplicity only clip 12 will be described in detail.

Figure 4:
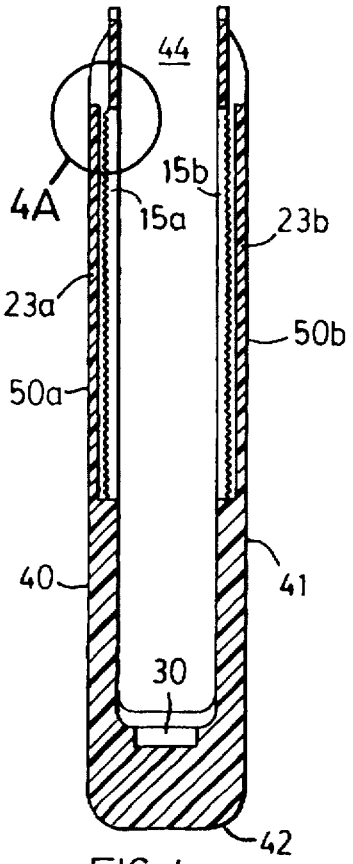
FIG. 4 is a cross-section of FIG. 2.
Figure 5A:
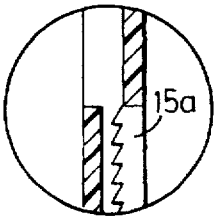
FIG. 5A is an enlarged view of a portion of FIG. 5.
Figure 5:
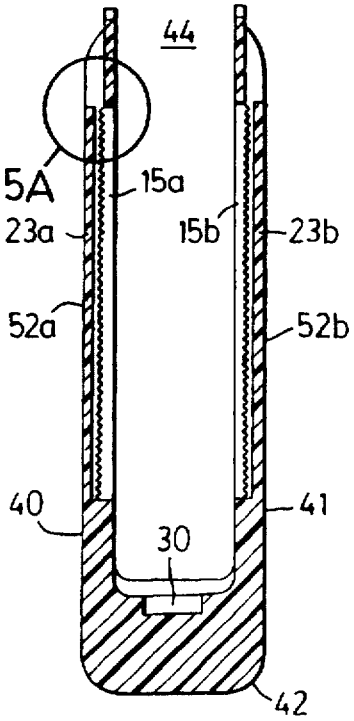
FIG. 5 is a cross section of FIG. 3.

As seen in FIG. 4 (FIG. 5 for clip 11) each clip is formed of two side walls 40 and 41 and a bottom wall 42 defining a U-shaped cavity 44 for receiving hockey stick blade 10.

Figure 2:
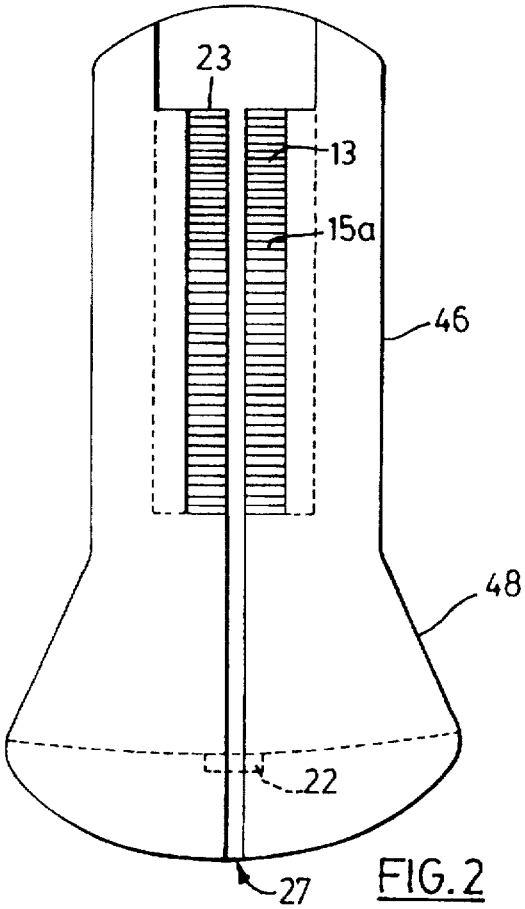
FIG. 2 is a front plan view of a first protector clip in accordance with an aspect of this invention.
Figure 3:
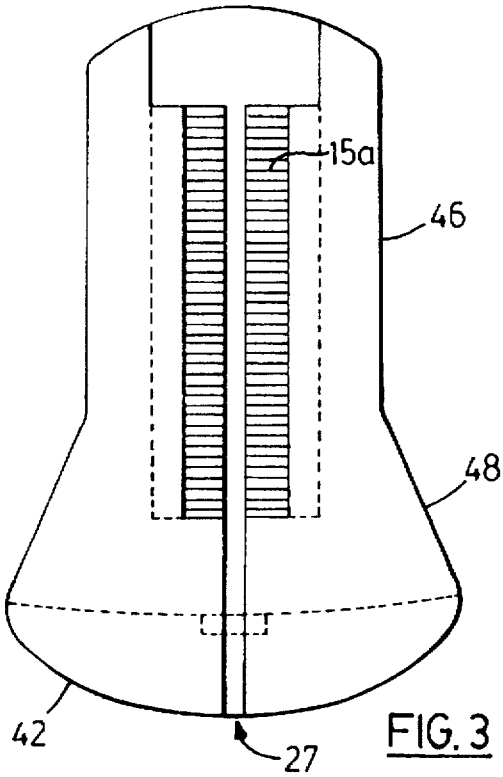
FIG. 3 is a front plan view of second protector clip in accordance with an aspect of this invention.
Figure 4A:
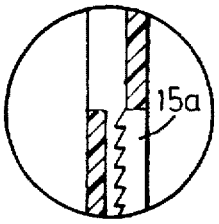
FIG. 4A is an enlarged view of a portion of FIG. 4.

As illustrated in FIGS. 1 and 2 (FIG. 3 for clip 11) each clip comprises an elongate portion 46 extending to a flanged portion 48. The bottom of flanged portion 48 has an arcuate, convex edge. Similarly, bottom wall 42 forms a convex outer surface that arcs outwardly away form the bottom of U-shaped cavity 44. Slots 23*a*, 23*b* are formed in each elongate portion of sidewalls 40 and 41. Each slot 23*a*, 23*b* has an outerwall 50*a*, 50*b*. Serrations 15*a* and 15*b* extend horizontally along a side of each clip exterior to cavity 44 and along an interior of slots 23*a*, 23*b*. The serrations 15*a*, 15*b* take the form of teeth, oriented downwardly toward the bottom of clip 12 (see FIGS. 4A and 5A for clip 11).

Figure 6:
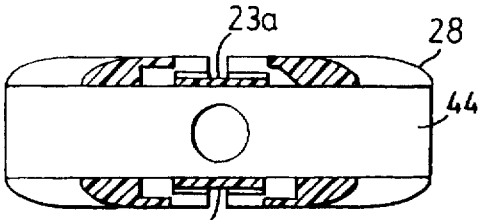
FIG. 6 is a top plan view of FIG. 2.
Figure 8:
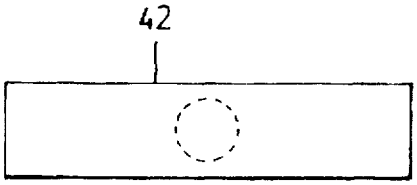
FIG. 8 is a bottom plan view of FIG. 2.

As best illustrated in FIGS. 2 and 6, a thin slot 27 extends in each side wall 40 and 41 from bottom wall 42 into and along slots 23*a* and 23*b*.

Figure 10:
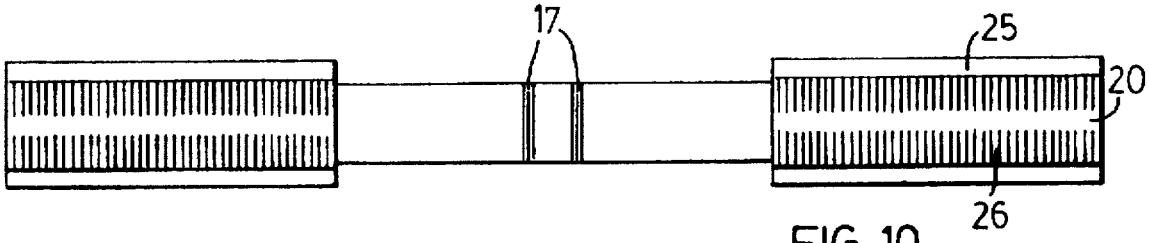
FIG. 10 is a bottom plan view of a retaining band in accordance with an aspect of this invention.
Figure 10A:
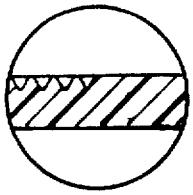
Figure 10A is an enlarged view of a portion of FIG. 10.
Figure 11:
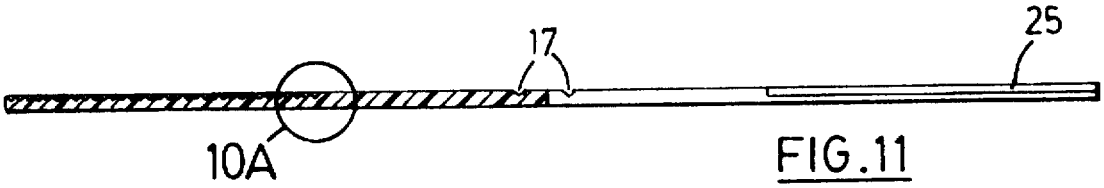
FIG. 11 is a side plan view of FIG. 10.
Figure 12:
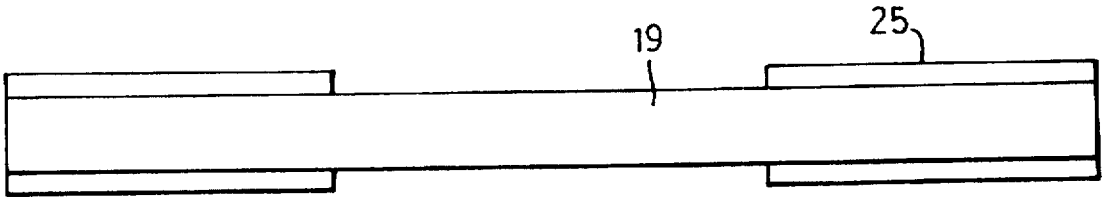
FIG. 12 is a top plan view of FIG. 10.

Identical attachment bands 18 and 19 are adapted to engage clips 11 and 12, respectively and act as retaining members to retain clips 11 and 12 on blade 10. As illustrated in FIGS. 10–12, each attachment band 19 is a thin, generally rectangular strip of flexible material that has two notches 17 extending from edge to edge proximate to and on either side of its centre along its length. Each band 19 is made of a flexible material similar to that used for forming clips 11 and 12. Notches 17 allow band 19 to be folded to form a generally V-shape, as shown in FIG. 1. Moreover, each band comprises a series of horizontal serrations 26 (also see FIG. 10A) extending on one side from proximate one edge to proximate the other edge along each bands' width. The bands are adapted to be slid into slots 23*a* and 23*b*. Wings 25 extend form the edges of bands 18 and 19 and glide within the edges of slots 23*a* and 23*b*. Within slots 23*a* and 23*b*, the serrations 26 of bands 18 and 19 are adapted to engage clip serrations 15*a* and 15*b*. Outerwalls 50*a*, 50*b* of slots 23*a* and 23*b* urge band serrations 26 into engagement with clip serrations 15. Moreover, groove 20 in band 19 lines up with slot 27 when bands 18 and 19 are slid in slots 23*a* and 23*b*.

Figure 13:
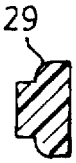
FIGS. 13 and 14 are side perspective views of a rubber bumper in accordance with an aspect of the invention.
Figure 7:
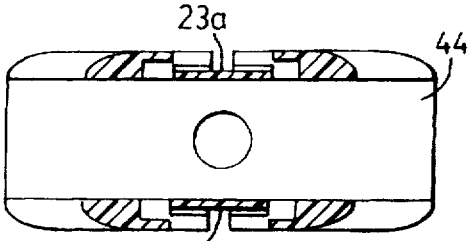
FIG. 7 is a top plan view of FIG. 3.
Figure 9:
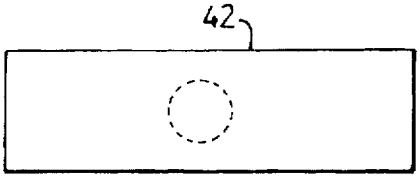
FIG. 9 a bottom plan view of FIG. 3.
Figure 14:
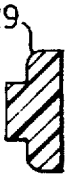

To ensure a tight fit between the bottom edge of blade 10 and the interior of bottom wall 42, a rubber bumper 29 (as illustrated in FIGS. 13, 14) may be inserted in the bottom of clips 11 and 12, and is thus interposed between the blade bottom and the bottom wall 42. U-shaped cavity 44 is further equipped with indentations 30 to receive bumper 21. This rubber bumper absorbs downward vertical shock on blade 10 and clips 11 and 12.

In use, rubber bumper 29 is inserted into cavity 44 until it rests within indentation 30. Clip 12 is slid on hockey stick blade 10, proximate the blade's tip until U-shaped interior 44 snugly engages blade 10. V-shaped retaining band 19 is slid atop clip 12 into slots 23*a*, 23*b* so that serrations 26 of band 19 engage serrations 15*a*, 15*b* on clip 12. As shown in FIG. 1, once clip 12 is installed on the hockey stick blade 10, the retaining band 19 extends from the first sidewall 40 to the second sidewall 41 over a top edge of hockey stick blade 10 for retaining the protector clip 12. Because clip serrations 15*a*, 15*b* face downwardly and band serrations 26 face upwardly when band 19 is inserted in slots 23*a*, 23*b* only one way motion of band 19 into slots 23*a*, 23*b* is easily possible.

Retaining band 19 is pressured downwardly toward the bottom of blade 10 until clip 12 is snugly seated on blade 10. Clip 11 is similarly installed through retaining band 18 near the heel of blade 10.

Once in place, clips 11 and 12 prevent the entire surface of a conventional hockey stick blade from making contact with the playing surface on which blade 10 is being used. Only the bottom portions of clips 11 and 12 are in contact with the playing surface. Similarly, as the bottom portion of clips 11, 12 are convex and arced outwardly away from the bottom of blade 10, the contact between clips 11, 12 and the playing surface is minimized. The bottom of the U-shaped outerwall of the clips 11 and 12 is also convex. This arrangement reduces the overall force of friction acting on the bottom of blade 10, and creates an appreciable gap between the bottom surfaces of clips 11 and 12 and the bottom edge of blade 10. Moreover, as clips 11 and 12 are made of durable plastic or the like their bottom surfaces are not easily abraded.

Once clips 11 and 12 wear out or are no longer required, they may be removed by sliding pins upwardly into slots 27 and groove 20 of band 18, thus lifting the serrations 26 of attachment band 18 or 19 out of engagement with the serrations 15*a*, 15*b* of clips 11 and 12.

A person skilled in the art will appreciate that numerous modifications to the above described preferred embodiment are possible. For example, retaining bands 18 and 19 need not be formed as flat foldable bands, but may be formed as complementary U-shaped attachment members engageable with clips 11 and 12.

It will be further understood that the invention is not limited to the illustrations described and shown herein, which are deemed to be merely illustrative of the best modes of carrying out the invention, and which are susceptible to modification of form, size, arrangement of parts and details of operation. The invention, rather, is intended to encompass all such modifications which are within its spirit and scope as defined by the claims.

I claim:

1. A hockey stick blade protector comprising:

an upstanding protector clip comprising a first and second sidewall and a bottom wall defining a cavity for receiving a bottom edge of a hockey stick blade;

at least one of said first and second sidewall having at least one sidewall serration extending generally horizontally along a side of said at least one sidewall, exterior to said cavity;

and a retaining member for retaining said protector clip on said hockey stick blade, said retaining member adapted to extend from said first sidewall to said second sidewall over a top edge of said hockey stick blade when said cavity receives said hockey stick blade;

said retaining member having at least one serration adapted to engage said at least one sidewall serration.

2. The hockey stick blade protector of claim 1 wherein said bottom wall has a convex outer surface when said cavity receives said hockey stick blade.

3. The hockey stick blade protector of claim 2 wherein said retaining member comprises a flexible retaining band.

4. The hockey stick blade protector of claim 3 further comprising a first elongate receiving slot in one of said sidewalls extending generally vertically in said one of said sidewalls, wherein said at least one sidewall serration is deposed in said first receiving slot, said receiving slot for receiving said retaining band.

5. The hockey stick blade protector of claim 4 further comprising a second elongate receiving slot in the other one of said sidewalls extending generally vertically in said other one of said sidewalls and a sidewall serration deposed in said other one of said sidewalls, said second receiving slot for receiving said retaining band.

6. The hockey stick blade protector of claim 5 further comprising first and second release slots extending vertically within said sidewalls from said bottom wall into said receiving slots.

7. The hockey stick blade protector of claim 6 further comprising a resilient insert, insertable in a mounting hole in said bottom wall in said cavity.

8. The hockey stick blade protector of claim 7 wherein said band has two grooves extending from edge to edge proximate a midpoint of said band along a length of said band.

9. The hockey stick blade protector of claim 8 wherein said at least one retaining member serration engages said at least one sidewall serration to permit one-directional sliding of said band toward said bottom wall within said receiving slots.

10. The hockey stick blade protector of claim 9 wherein said band comprises a groove along said length of said band, and wherein said groove aligns with said release slots when said band is in said receiving slots.

11. A hockey stick blade protector comprising a first and second protector clip wherein each protector clip comprises:

a first and second sidewall and a bottom wall defining a cavity for receiving a bottom edge of a hockey stick blade;

said first and second walls having at least one sidewall serration extending generally horizontally along a side of said sidewalls exterior to said cavity;

and a retaining member adapted to extend from said first sidewall to said second sidewall over a top edge of said hockey stick blade for retaining said protector clip;

said retaining member having a plurality of serrations adapted to engage said at least one sidewall serration;

said first clip adapted for attachment to said hockey stick blade proximate a first end of said hockey stick blade and said second clip adapted for attachment to said hockey stick blade proximate a second end of said hockey stick blade.

12. A hockey stick blade protector for attachment to a hockey stick blade comprising:

an upstanding protective clip comprising a first and second sidewall and a bottom wall defining a cavity for receiving a bottom edge of a hockey stick blade;

wherein said bottom wall has a convex outer bottom surface, when said hockey stick blade is received by said cavity;

a flexible retaining band for attaching said protective clip to said blade; and at least one interengageable serration on each of said clip and said retaining band.

13. The hockey stick blade protector of claim 12 further comprising a first and second elongate receiving slot for receiving said retaining band in each sidewall, said receiving slots extending generally vertically in said sidewalls, wherein said at least one interengageable serration on said clip is deposed in at least one of said receiving slots.

14. The hockey stick blade protector of claim 13 wherein said band has two grooves extending from edge to edge of said band proximate and on either side of a midpoint of said band along a length of said band.

15. The hockey stick blade protector of claim 14 wherein said interengageable serrations on said retaining band and said clip engage each other to permit one directional sliding of said band toward said bottom wall within said receiving slots.

16. The hockey stick blade protector of claim 12 further comprising a resilient insert, insertable in a mounting hole in said bottom wall in said cavity.

* * * * *